United States Patent [19]

Honjo

[11] Patent Number: 4,500,774

[45] Date of Patent: Feb. 19, 1985

[54] CAR CIGAR LIGHTER

[75] Inventor: Kazumi Honjo, Tokyo, Japan

[73] Assignee: Niles Parts Company, Limited, Tokyo, Japan

[21] Appl. No.: 568,405

[22] Filed: Jan. 5, 1984

[30] Foreign Application Priority Data

Nov. 16, 1983 [JP] Japan ..... 58-177313[U]

[51] Int. Cl.[3] ..... F23Q 7/00

[52] U.S. Cl. ..... 219/265; 219/267; 219/269; 337/297; 340/815.15; 362/802

[58] Field of Search ..... 219/220, 262, 263, 264, 219/265, 267, 269, 506, 512; 337/6, 296, 297; 340/815.01, 815.15; 362/100, 135, 184, 802

[56] References Cited

U.S. PATENT DOCUMENTS

| | | | |
|---|---|---|---|
| 2,037,882 | 4/1936 | Cohen | 219/269 X |
| 2,648,756 | 8/1953 | Kroll et al. | 219/269 |
| 3,433,928 | 3/1969 | Horwitt | 219/267 |
| 3,462,581 | 8/1969 | Bristol et al. | 219/267 |
| 3,518,408 | 6/1970 | Pitacco | 219/264 |
| 3,975,619 | 8/1976 | Uda | 219/269 |
| 4,016,400 | 4/1977 | Seibel et al. | 219/264 |
| 4,270,038 | 5/1981 | Narihashi | 219/269 |
| 4,459,464 | 7/1984 | Oda et al. | 219/264 |

*Primary Examiner*—Volodymyr Y. Mayewsky

*Attorney, Agent, or Firm*—Lane, Aitken and Kananen

[57] ABSTRACT

The car cigar lighter of the present invention has such construction that it can easily be mounted on the panel nearby the driver's seat of a car and is superior in the operating ease and safety. Namely, it is characterized in that a holder and a positioning projection are formed on a socket by processing and on the other hand, at the center of a plug housed into said socket, a circular groove is formed and at the skirt portion of said plug, a ringed projection is formed respectively to enable controlling the sinking action of the knob by engaging the component members mentioned above with each other and also, with a base holder fixed into the cavity of the knob, a push nut secured to the base shaft of shaft body is press-fitted into the base holder to stick the knob easily to the shaft body. Further at the opening edge of a flange, a heat insulating resin ring is fitted to cover the edge, whereby any person who uses the cigar lighter can be prevented from getting burned.

5 Claims, 5 Drawing Figures

CAR CIGAR LIGHTER

BACKGROUND OF THE INVENTION

1. Field of the Invention

The present invention relates to a car cigar lighter mounted on a panel board near the driver's seat of a car to provide drivers the ease of smoking.

2. Description of the Prior Art

Generally, the cigar lighter used for vehicles comprises a plug assembly having a knob and a socket assembly having a bimetal. The cigar lighter available conventionally has been so constructed that the position of the plug assembly knob inserted into the socket assembly moves in 3 steps, i.e., a SET position in its ordinary state, an ON position where a heater is actuated by pushing the knob inward, and an OFF position where the knob pops out and the heating operation terminates. This is the result of due consideration given to minimize the protrusion of the knob out of the instrument panel at other positions than the OFF position because, if the knob is projecting too much from the instrument panel, there is a possibility of the driver touching the knob by some chance, e.g., when the vehicle has stopped suddenly.

However, as for the conventional cigar lighter used for the cars so far, the socket and plug that are the component parts of the cigar lighter have been long and besides, the shaft body provided with a heater cap has also been long, which has encountered a difficulty in making the cigar lighter in a very small size.

Also in the traditional cigar lighter, the mounting construction of the base shaft and the knob has been such that the base shaft is fitted directly to the knob with a clamp, e.g., a bolt. It has been made clear, however, that the assembly time increases and it is unsuitable for mass production.

Further, in a car cigar lighter which has been so constructed as to sink the knob into the instrument panel as far as possible, the knob length has been set just long enough to enable picking up the knob with thumb and fingers. Therefore, the plug assembly has been provided with a heat insulating means to prevent finger(s) from getting burned when taking a grip of the knob while putting the plug assembly in and out of the socket assembly.

However, with respect to the conventional car cigar lighter provided with the heat insulating means in the construction that the knob moves in 3 steps, the construction has become intricate with the increase in the number of parts and lots of manhours have been required for the assembly process.

SUMMARY OF THE INVENTION

The present invention has been made to overcome the disadvantages inherent in the above-discussed types of prior art cigar lighter.

An object of the present invention is to provide a novel car cigar lighter making the construction simpler with fewer parts to minimize the manhours in the assembly process by forming a heat insulating resin ring as an integral piece at the opening edge to cover the periphery of the opening edge for the plug of the plug assembly and, at the same time, by providing a ringed groove and a ringed projection to support a spring bearing seat carrying a spring which controls the movement of the knob and, on the other hand, by providing the socket of the socket assembly with a positioning projection contacting the tip of said ringed projection to control the inserting position of said plug and a holder contacting the outer wall of said ringed projection at an OFF position to bring the popping-out of the plug assembly to a halt.

It is another object of the present invention to provide a novel car cigar lighter incorporating an impressively simple fixing system of the knob and suitable for mass production, with such construction that a base shaft is secured to a shaft body fitted with a heater cap and a push nut is riveted on the base shaft and at the same time, a base holder made of metal is formed in the cavity of the knob as an integral piece. The knob and the shaft body are joined simply and quickly by press-fitting the shaft body and the appended push nut into the base holder formed in the cavity of said knob.

It is a further object of the present invention to provide a novel knob sinking type car cigar lighter having a simple configuration and construction by providing the socket with a positioning projection to allow the ringed protrusion of the plug to come in touch with this positioning projection thereby to control the advance of said plug, and by forming a circular groove at a predetermined position of the plug thereby to prevent said plug from popping out of the socket after heating of a hot-wire coil and further by engaging the holder formed on the socket into the circular groove.

BRIEF DESCRIPTION OF THE DRAWINGS

FIG. 1 is an assembly sectional view showing a condition where the plug assembly is in a SET position.

FIG. 4 is a partially cutaway, exploded, perspective view of a car cigar lighter.

DESCRIPTION OF THE PREFERRED EMBODIMENT

Referring to the attached drawings, there is given a detailed description of one embodiment of the car cigar lighter of the present invention.

Figure 1:
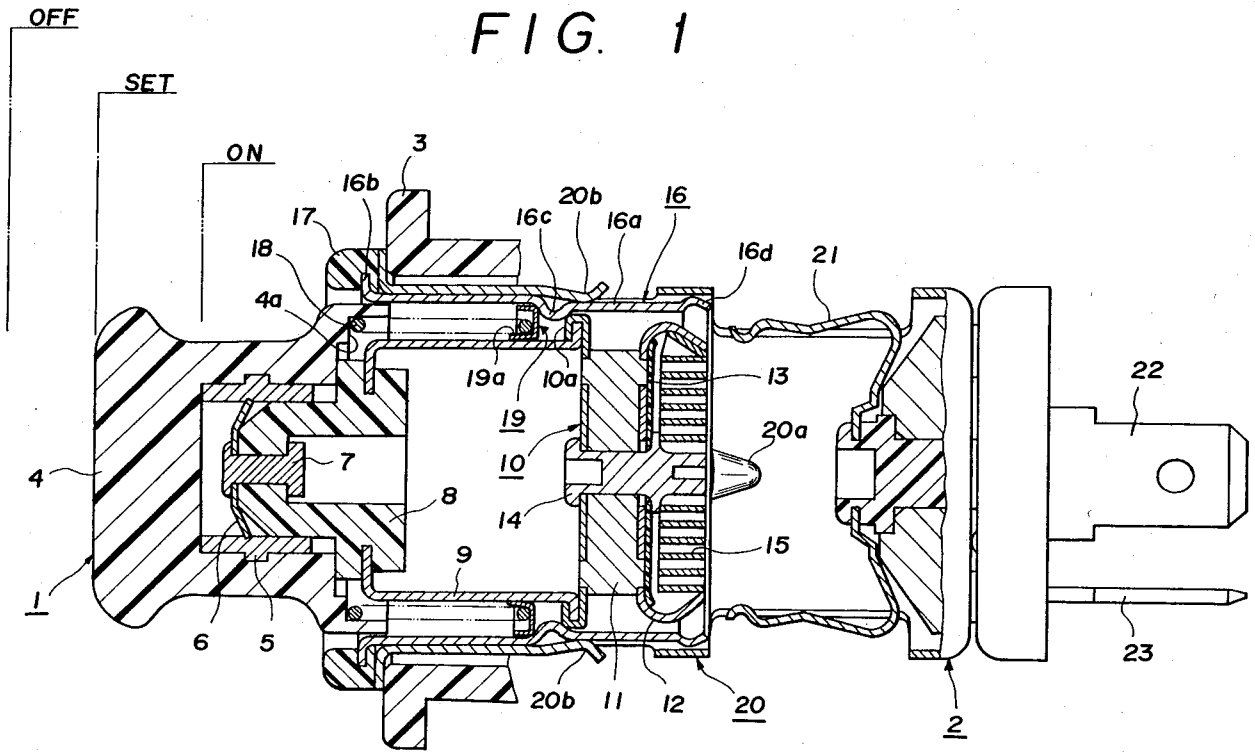
FIG. 1 or FIG. 4 shows one embodiment of the car cigar lighter of the present invention.
Figure 4:
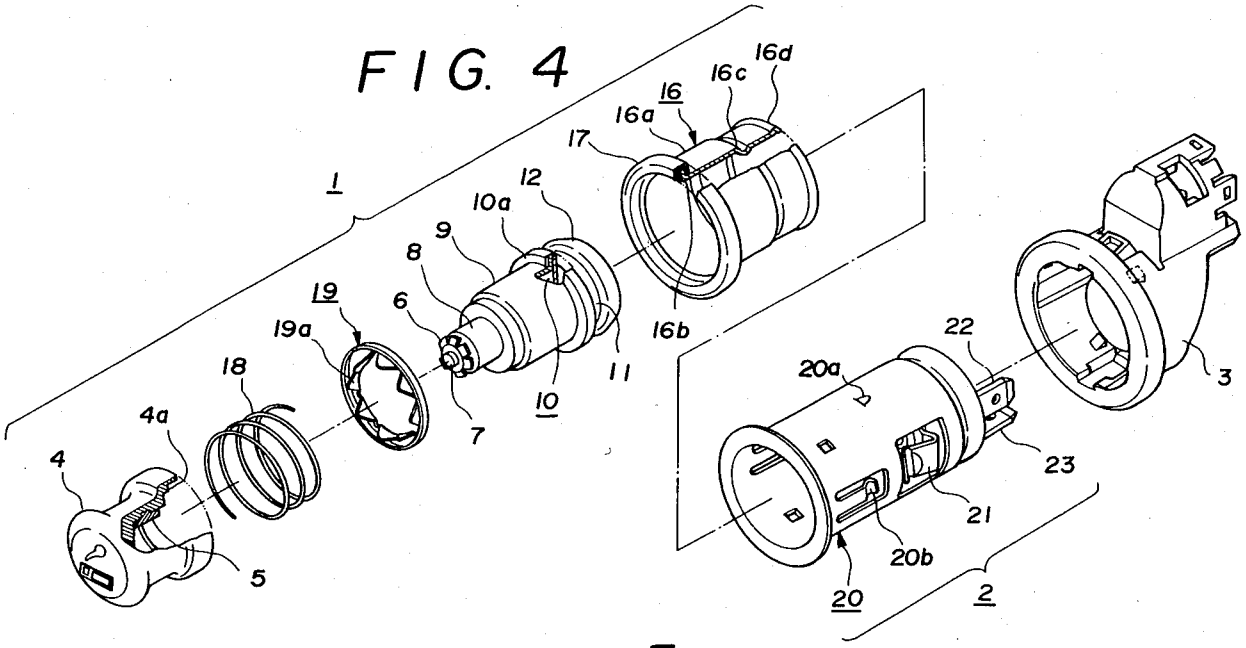
Figure 5:
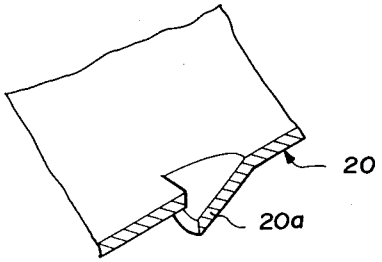
FIG. 5 is a sectional enlarged view of the positioning projection of socket in FIG. 4.

In FIG. 1 or FIG. 4, 1 is a plug assembly and 2 is a socket assembly. 3 is an illuminating ring which lights the vicinity of a knob 4 of the plug assembly 1 and which is fitted to the socket assembly 2 to introduce the light of a lamp (not shown).

The knob 4 made of resin is molded integral with a base holder 5 made of metal. Also, a base shaft 8 formed with a heat insulating resin to reduce thermal conduction to the knob 4 is molded integral with a shaft body 9 at the one end thereof and fixed by staking with a rivet 7 together with a push nut 6 at the other end thereof. The shaft body 9 is fixed by staking with an outer peripheral edge 10*a* of a stopper plate 10. The stopper plate 10, a heater base 11, a heater cap 12 and an electric insulation plate 13 are all fixed by staking with a rivet 14. A hot-wire coil 15 formed spirally is spot-welded to the heater cap 12 at the one end thereof and to the rivet 14 at the other end thereof.

A plug 16 substantially comprises a cylindrical shell portion 16*a*, a flange 16*b* fitted to the front end of said shell portion 16*a*, a ringed groove 16*c* provided almost at the center of the shell portion 16*a* and a ringed projection 16*d* installed at the tip of the shell portion 16*a*. At the opening edge of the flange 16*b*, a heat insulating resin ring 17 covering the periphery of the flange is formed as an integral piece. A coil spring 18 controlling the movement of the knob 4 contacts an inner wall 4*a* of the knob 4 at the one end thereof and is supported by a spring bearing seat 19 contacting the inner wall of the ringed groove 16*c* in the plug 16 at the other end thereof.

The plug assembly 1, as shown in FIG. 4, is constructed during assembly by inserting the spring bearing seat 19, the coil spring 18 and the knob 4 into the plug 16 from a direction of the flange 16*a* and further by inserting a heater block 6 or 15 from a direction of the ringed projection 16*d* to press-fit the push nut 6 to the base holder 5. Moreover, in the spring bearing seat 19, a lot of corrugated spring pieces 19*a* formed on the inner circumferential face of the spring bearing seat always contact the outer wall of the shaft body 9 with spring, whereby a condition of electrical conduction is assured.

In the socket assembly 2, a socket 20 incorporates a bimetal 21 fitted securely to the bottom thereof. Moreover, the bimetal 21 insulated electrically from the socket 20 is connected to a power terminal 22. Also, an earthing terminal 23 is connected electrically with the socket 20.

The socket 20, to control the inserting position of the plug 16, includes two pieces of a positioning projection 20*a* made by an embossing process to protrude out of the inner wall and two pieces a holder 20*b* fitted with an elastic force provided to hold the outer wall of the shell 16*a* at the plug 16 by press-gripping and at the same time allow these holders to contact the ringed projection 16*d*.

Moreover, the plug assembly 1, as shown in FIG. 4, is constructed by assembling the knob 4, the coil spring 18, the spring bearing seat 19, the shaft body 9 and the plug 16. On the other hand, the socket assembly 2 is constructed by assembling the socket 20, the bimetal 21, the power terminal 22 and the grounding terminal 23.

There is given hereunder a description of the action of the car cigar lighter.

When the plug assembly 1 is in a SET position shown in FIG. 1, the positioning projection 20*a* of the socket 20 is in contact with the tip of the ringed projection 16*d* to control the inserting position of the plug 16. Further, the holder 20*b* is gripping the outer wall of the shell portion 16*a* with pressure at the plug 16. The SET position where the positioning projection 20*a* contacts is the deepest inserting position of the plug 16 at the SET position. In this condition, the hot-wire coil 15 is not heated up.

Figure 2:
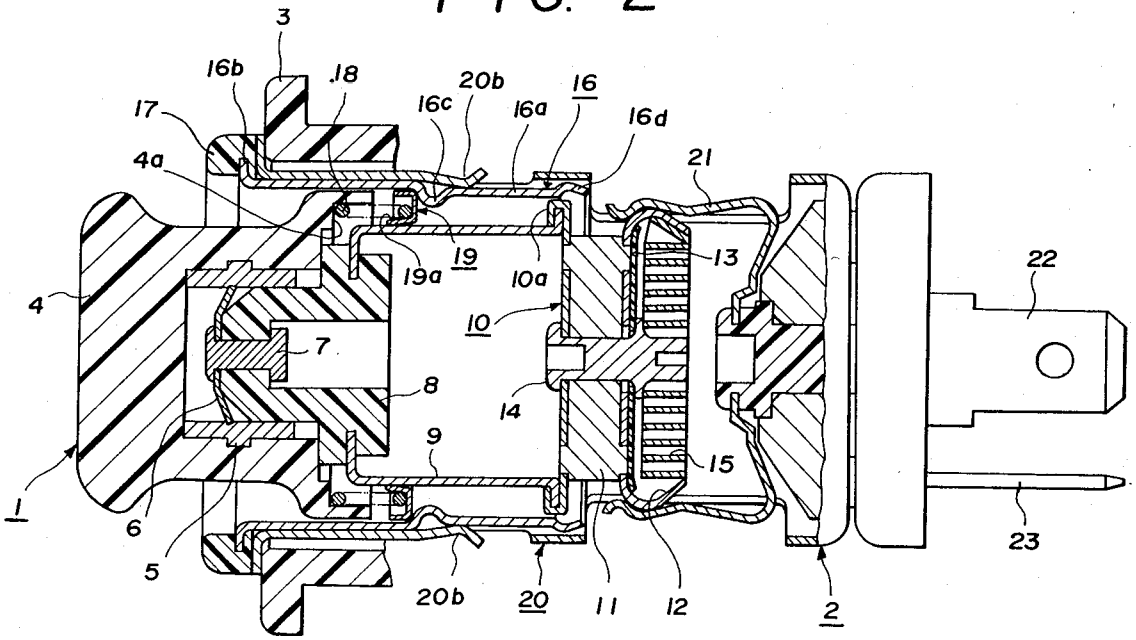
FIG. 2 is an assembly sectional view showing a condition where the plug assembly is in an ON position.

In its ON position where the knob 4 has been pushed in forcibly from the SET position in FIG. 2, the heater cap 12 is pushed out of the interior of the plug 16 to get into the bimetal 21 and gripped by the bimetal 21. Consequently, current coming from a d-c power supply (not shown) is routed to the power terminal 22, the bimetal 21, the heater cap 12, the hot-wire coil 15, the rivet 14, the stopper plate 10, shaft body 9, the spring bearing seat 19, the plug 16, the socket 20, the grounding terminal 23 and a ground in this order, whereby said hot-wire coil 15 is heated up.

Figure 3:
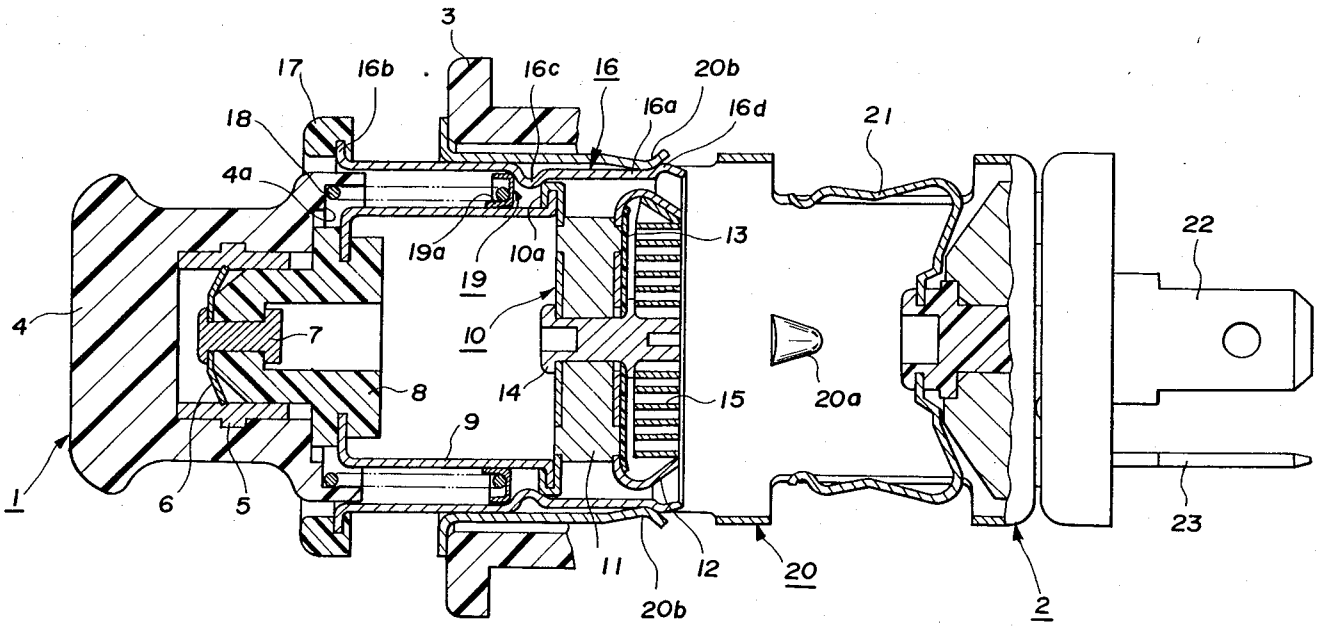
FIG. 3 is an assembly sectional view showing a condition where the plug assembly is in an OFF position.

Thereafter, the bimetal 21 opens outward after the hot-wire coil 15 has been heated up to a specified temperature at the aforesaid ON position to open the heater cap 12. Then, the plug assembly 1 pops out to an OFF position shown in FIG. 3 with the resilient force of the coil spring 18. The popping-out action of the plug assembly 1 halts because of the holder 20*b* of the socket 20 coming in contact with the outer wall of the ringed projection 16*d*, thus preventing the plug assembly from slipping off the socket 20. And, the OFF position is a position just before the plug assembly 1 is drawn out and it can be confirmed visually as the point of time when the heating of the hot-wire coil 15 terminates.

Moreover, at the SET position and the OFF position, the knob 4 is restrained from popping out of the plug 16 against the resilient force of the coil spring 18 owing to the contact between the outer circumferential edge 10*a* of the stopper plate 10 and the inner wall of the ringed groove 16*c*.

The car cigar lighter of the present invention has the aforementioned specific construction and action and offers the following advantages.

For the plug of the plug assembly, at the opening edge, a heat insulating resin ring covering the opening edge is formed as an integral piece and, at the same time, a ringed groove and a ringed projection are provided. Further, a spring bearing seat carrying a spring which controls the movement of the knob is supported by the inner wall of said ringed groove. For the socket assembly, as a result of a positioning projection contacting the tip of the aforesaid ringed projection to control the inserting position of said plug and a holder contacting the outer wall of the ringed projection at an OFF position to bring the popping-out action of the plug assembly to a halt having been fitted, the assembled length is impressively small and the construction becomes simpler with fewer parts, which substantially lessens the manhours in the assembly process.

Also, the cigar lighter of the present invention is so constructed as to fit a base holder into the cavity of the knob and push a base shaft having a push nut secured to the end thereof into the base holder for press-fitting. Therefore, the fixing means of the knob and the shaft body is quite simple, which permits the assembly manhours to be reduced and at the same time the number of parts assembled to decrease.

Forming a positioning projection in the socket with a ringed projection formed at the skirt portion of the plug to allows this ringed projection to control the advance of the plug by contacting the above-mentioned positioning projection. Making a circular groove almost at the center position of the plug prevents the plug from popping out of the socket after completion of the heating of the hot-wire coil of the heater cap and, also, engaging a holder fitted to the socket in the circular groove. These features provide, over all, a simple part configuration for a knob sinking-type car cigar lighter having a short plug that is well-suited for the efficient use of cost-saving mass production methods.

The present invention has been described in detail above with reference to the preferred embodiment thereof, but it is not limited to the car cigar lighter having the construction and features described hereinabove, and it will be apparent from the items according to the claims below.

I claim:

1. A car cigar lighter substantially comprising a plug assembly having a knob and a socket assembly having as bimetal, wherein a flange is fitted to the front end of a cylindrical shell portion of a plug housing, said knob of the plug assembly with a ringed groove provided almost at the center of said shell portion of the plug, a ringed projection provided at a skirt portion of the shell of said plug with a heat insulating resin ring covering the periphery of the opening edge of said flange formed at the edge as an integral piece, a spring controlling the movement of the foregoing knob and supported by a spring bearing seat having one end coming in contact with the inner wall of said knob and the other end contacting the inner wall of the aforesaid ringed groove, and at a SET position, a positioning projection provided on the inner wall of a socket contacts the tip of said ringed projection to control the inserting position of the plug and, at the same time, a holder in the socket grips the outer wall of said plug with pressure, at an ON position, the outer circumference of a heater cap of the foregoing plug assembly is retained engaging with said bimetal of the socket assembly and further, at an OFF position, said plug assembly pops out because of the resilient force of said spring and because said holder in the socket comes into contact with the outer wall of said ringed projection to halt thereat.

2. A car cigar lighter according to claim 1, wherein a plug assembly is made by fitting a base holder into the cavity of said knob and pressing a push nut secured to the end of a base shaft fixed onto a shaft body into said base holder for fixing.

3. A car cigar lighter according to claim 1, wherein said spring bearing seat has a plurality of corrugated spring pieces formed at the inner circumferential face thereof and the spring pieces are in contact with the foregoing shaft body.

4. A car cigar lighter according to claim 1, wherein said positioning projection and said holder are formed as an integral piece by processing the said socket.

5. A car cigar lighter according to claim 1 or claim 4, wherein an illuminating ring is provided.

* * * * *